US005339896A

United States Patent [19]

Hart et al.

[11] Patent Number: 5,339,896

[45] Date of Patent: Aug. 23, 1994

[54] FIELD INSTALLABLE ROD GUIDE AND METHOD

[75] Inventors: Charles M. Hart, Stinnett; H. Milton Hoff, Jr., Tomball; John L. Tillman, Jr., The Woodlands; Lindell R. Trout, The Woodlands; Stephen L. Witte, Sr., The Woodlands, all of Tex.

[73] Assignee: J. M. Huber Corp., Tomball, Tex.

[21] Appl. No.: 58,106

[22] Filed: May 6, 1993

[51] Int. Cl.[5] ..... E21B 17/10

[52] U.S. Cl. ..... 166/241.1; 166/241.2

[58] Field of Search ..... 166/172–174, 166/241.1, 241.2, 241.3

[56] References Cited

U.S. PATENT DOCUMENTS

| | | | |
|---|---|---|---|
| 2,928,472 | 3/1960 | Tripplehorn . | |
| 3,442,558 | 5/1969 | Sable . | |
| 4,088,185 | 5/1978 | Carson | 166/241 X |
| 4,858,688 | 8/1989 | Edwards et al. | 166/241 |
| 5,115,863 | 5/1992 | Olinger | 166/241 |
| 5,119,876 | 6/1992 | Sable | 166/241.2 |
| 5,191,938 | 3/1993 | Sable et al. | 166/241.4 X |
| 5,247,990 | 9/1993 | Sudol et al. | 166/241.3 |

*Primary Examiner*—Michael Powell Buiz
*Attorney, Agent, or Firm*—Browning, Bushman, Anderson & Brookhart

[57] ABSTRACT

A rod guide is provided for centering a sucker rod within a tubular string that powers the pump within a well bore. The rod guide comprises a spool securable to the rod and having upper and lower end members thereon, and a plastic material sleeve extending between the upper and lower end members. The sleeve may be mounted to the rod during a molding operation. The rod guide further includes a guide body which may be machined from an ultra-high molecular weight polyethylene material which has desired abrasive and wear characteristics. In one embodiment, the body is rotatable about the spool. A slot within the guide body and scalloped-shaped cut-outs at both ends of the guide body provide fluid communication between an annulus formed between the O.D. of the sleeve portion of the spool and the I.D. of the guide body. An improved method of positioning a guide body on a spool member affixed to a rod is disclosed, and a test apparatus for testing the characteristics of a rod guide is also simplistically illustrated.

40 Claims, 3 Drawing Sheets

FIELD INSTALLABLE ROD GUIDE AND METHOD

FIELD OF THE INVENTION

The present invention relates to a guide for maintaining tubular goods generally aligned within a well bore of an oil, gas, water, or geothermal well. More particularly, the invention relates to a guide for a sucker rod used to drive a downhole pump within a well bore, with the rod guide being designed for easy installation at the well site. A new rod guide test tool is also disclosed.

BACKGROUND OF THE INVENTION

Those skilled in the hydrocarbon recovery industry understand that pumps at the lower end of wells are conventionally used to pump oil to the surface via production tubing positioned within a well casing. The pump is typically powered at the surface, with the power being transmitted through a rod string positioned within the production tubing. A rod string conventionally has been reciprocated to drive the downhole pump, although a progressing cavity pump driven by a rotating rod is being increasingly used, particularly in wells producing heavy, sand-laden oil or producing fluids with high water oil ratios.

Whether the rod which drives the pump (the sucker rod) reciprocates or rotates, the rod generally is guided so that it does not rub against the interior walls of the production tubing, and thus cause excessively wear on either the sucker rod, the sucker rod couplings, or the production tubing. In practice, sucker rods and production tubing almost never hang perfectly concentric within a well. Moreover, few if any wells produce crude oil free of abrasives and water, and those contaminants increase wear if the sucker rod string contacts the inside of the production tubing. Whether the pump driving system utilizes a reciprocating or a rotating rod, tubing wear and rod wear accelerate as production rates, hole deviations, water/oil ratios, and sand concentrations increase. While rod guides traditionally have thus long been used to generally center the rod within the production tubing, the need for improved rod guides increases with the changing variables discussed above.

Many rod guides have a plurality of radially outward projecting fins, ribs, or vanes with a fin outer diameter (O.D.) close to the internal diameter (I.D.) of the production tubing, so that the fins achieve a maximum standoff between the rod coupling and the tubing. The cross-sectional area or annular spacing between the rod guide and tubing, coupled with the length to diameter (L/D) ratio of the rod guide, and the shape and smoothness of the rod guide, determines the undesirable pressure drop across this type of guide, which must be overcome by the downhole pump. Other rod guides are unfinned and have a generally cylindrical outer body, with the body having an O.D. smaller than the I.D. of the tubing. The difference or annular space between the maximum O.D. of the guide body and tubing I.D., coupled with the L/D ratio and the shape and smoothness of the rod guide, determines the pressure drop across this type of rod guide. Since the standoff between the rod couplings and the tubing is also less for this latter type of rod guide, unfinned rod guides have a disadvantage of less erodible wear volume (EWV) to prevent metal-to-metal contact between the sucker rod or rod couplings and the production tubing, and thus tinned rod guides are often favored by oil recovery operators.

Rod guides are traditionally spaced along the length of a rod string to prevent the rod string from engaging the tubing string. To maintain the rod guides at their desired spacing along the sucker rod, rod guides installed in the field are manufactured using plastic, rubber, and metal. Various designs are used to create a frictional grip on the rod in order to secure the rod guide in position. Field installed rod guides (FIGS) traditionally do not maintain their desired gripping engagement with the rod over a long period of time, particularly when high axial forces are encountered by the rod guide and when increasingly more power is transmitted from the surface to the downhole pump through the rod. While it is thus desirable that a rod guide be installed at the well site or at a location convenient to the well operator, FIGS traditionally are not able to achieve reliable engagement with the rod. Other versions of FIGS utilize a rubber guide body with a metal C-spring molded within the rubber body to supply a supplemental force which increases the frictional grip of the guide to the rod, as disclosed in U.S. Pat. No. 4,928,472. This latter type of rod guide is typically unfinned and has a high pressure drop, and generally is also poor at reliably securing the guide to the rod.

Rod guides manufactured from plastic have been molded directly onto the rod. These molded-on rod guides, as disclosed in U.S. Pat. No. 4,088,185, thus have the advantage of more reliably engaging the rod to maintain the rod generally concentric within the tubing string. Molded-on rod guides are also relatively inexpensive to manufacture, although these prior art rod guides have the disadvantage of practically requiring that the entire rod be sent from the field to a molding facility to remove a worn-out guide and mold on a new guide, after which the rod with new guides may then be returned to the field. A rod guide with a diagonal slot designed for maintaining a guide on a rod is disclosed in U.S. Pat. No. 3,442,558, while a similar snap-on guide and scraper is disclosed in U.S. Pat. No. 3,282,344. A field installable rod guide is disclosed in U.S. Pat. No. 4,858,688.

A significant problem with rod guides concerns balancing the opposing desires of maximizing the life of the rod guide (which is related to the erodible wear volume), while also minimizing the pressure drop across the rod guide which the pump must overcome to transmit the fluids to the surface. For a tinned or ribbed rod guide, the life of the rod guide is enhanced by providing thick ribs which produce a substantial wear area for the guide to contact the tubing string. The more erodible wear volume (EWV) for a rod guide, the longer the rod guide is likely to last in the field, although such increased erodible wear volume also undesirably increases the pressure drop across the rod guide. A significant advantage is achieved by maximizing these factors in the manner described in U.S. Pat. No. No. 5,115, 863.

U.S. Pat. No. 5,119,876 discloses one version of a rod guide including a cylindrical centralizer body which hinges open during a spreading operation for insertion on a mount provided on the rod guide shank. The centralizer body is returned to its cylindrical shape after installation, and the centralizer body is welded to maintain its desired cylindrical form while on the rod. This type of rod guide has not proven to result in long life, and the operation of bonding the split body to its desired cylindrical form after installation is a drawback to easy field serviceability.

Improved rod guides and methods for installing such rod guides are thus desired by oil recovery operators to meet the demands of operators for fluid recovery systems which can operate at high production rates, which can operate in substantially deviated holes, which can reliably recover hydrocarbons with high water/oil ratios, and/or which can recover fluids contaminated with sand or other abrasives. The disadvantages of the prior art are overcome by the present invention, and an improved a rod guide, a method of installing a rod guide, and a test unit for testing a rod guide are hereinafter disclosed.

SUMMARY OF THE INVENTION

In one embodiment, the rod guide of the present invention is designed for use with a rotating rod string. Other embodiments are provided for use on a reciprocating rod string. In either case, the rod guide comprises a body which preferably has a slot along the length thereof and a plurality of radially outward projecting fins. The body is preferably formed from an ultra-high molecular weight (UHMW) polyethylene material. The slot in the rod guide body allows the body to be spread apart when snapped on a spool affixed to the rod. The spool, in turn, may be mechanically bonded to the rod when the plastic spool is molded on the rod. Spool ends serve as stops for positioning the guide body therebetween.

For the spinning rod guide embodiment, the body is free to rotate about the spool and thus about the spool secured to the rod. As the rod rotates, the spool may thus remain in stationery engagement with a sidewall of the production tubing to centralize the rotating rod within the well bore. The guide body preferably has an angled slot extending along the axial length of the guide body, and relatively clean fluid may freely pass between the slot and a gap between the I.D. of the body and the O.D. of a sleeve portion of the spool, so that the mechanical connection between the guide body and the spool is continually being washed while fluid flows past the rod guide. The top and bottom ends of the guide body include a plurality of relatively wide and deep scalloped cut-outs, and fluid passageways through the sleeve portion of the spool may further assist in this desired washing action. A gap between the ends of the guide body and the stop surfaces on the spool are provided to ensure smooth relative rotation between the guide body and the spool, and still further assist in the desired washing action. A plurality of relatively thin pads at the ends of the guide body engage stop surfaces on the spool, and wear on the guide body is minimized by its UHMW polyethylene material composition.

In one embodiment of the rod guide designed for use on a rod reciprocating in a well bore, a spool similar to that discussed above may include an elongate projection which fills a slot provided in a similar guide body. Relative rotation between the spool and the guide body thus does not occur, and accordingly wear between the spool and the body is minimal. Wear on the exterior surfaces of the guide body is reduced by the UHMW composition of the guide body. In another embodiment of a reciprocating rod guide, the spool may be modified for cooperating with scalloped cut-outs in the top and bottom ends of a guide body to prevent relative rotation, and accordingly the same guide body may be used on both a rotating or a reciprocating rod guide to minimize costs and inventory.

Various embodiments of the present invention have a guide body with a slot which allows the body to be easily snapped off a spool, and a new guide body snapped on the spool during an easy, inexpensive, and uncomplicated field operation. The amount of material expansion necessary to snap a guide body on a spool may be minimized, and different guide body materials may be used having desired wear characteristics in view of other characteristics (including material costs) of the selected guide body material.

A testing tool is also disclosed for testing a rod guide during or after rod guide development, and allows a variable side loading to be placed upon a rod guide within a powered rod which, for purposes of the test, is mounted substantially horizontally and may be driven by a variable speed motor. A flowmeter allows flow through the test tool to be monitored, and connections on the test unit facilitate monitoring both the pressure drop across the rod guide and the power required to rotate the rod.

It is an object of the present invention to provide a rod guide having a guide body with a slot along the entire length of the guide body, so that the guide body may be easily snapped on and off a spool secured to the rod. Accordingly, the rod guide body of this invention is easily installable in a field operation, thereby significantly reducing the overall costs of powering a downhole pump.

It is feature of the present invention that the material for the guide body may be manufactured from UHMW polyethylene, which has desired abrasive resistant characteristics, good wear characteristics, and a relatively low coefficient of sliding friction when engaging the same or other materials.

Another feature of the present invention is that an elongate slot in the guide body may be angled for the rotating rod guide, thereby improving the lock-on characteristics of the guide body.

Still another feature of the invention is that the slot provided in the rotating guide body may be substantially wide to facilitate washing between the spool and the guide body. This wide slot also facilitates the use of less resilient materials for manufacturing the guide body by reducing the amount of flex required to install the guide body.

Another feature of the invention is that the body of a rotating guide may have scalloped ends for further facilitating washing between the guide body and the spool during operation of a rotating guide.

Yet another feature of this invention is that the same guide body may be utilized for both a reciprocating rod and a rotating rod, thereby substantially minimizing costs and inventory.

Another feature of this invention is that an improved test unit is utilized to assist in designing a rotating rod guide, wherein a test head for receiving the rod and the guide is positioned such that the rod is substantially horizontal. A variable side load may be easily applied to the rod, while sensors or meters monitor the fluid flow through the test unit, the pressure loss or drop across the rod guide, and the power to the variable speed drive used to rotate the rod.

Since a worn guide body may be easily removed from a spool and a new guide body installed on that spool, it is an advantage of the present invention that a plurality of excess spools may be provided along a length of a rod for subsequently receiving guide bodies once a used spool is worn or to attach additional guides as needed.

It is a further advantage of this invention that the material composition of the guide body may be selected from an expanded list of possible materials, including metal as well as plastic, due to the design of the rod guide, which minimizes the material expansion required to snap a guide body on or off a spool.

It is a further advantage of the invention the various techniques may be used to secure a guide body to a spool affixed to a reciprocating rod guide according to the present invention.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
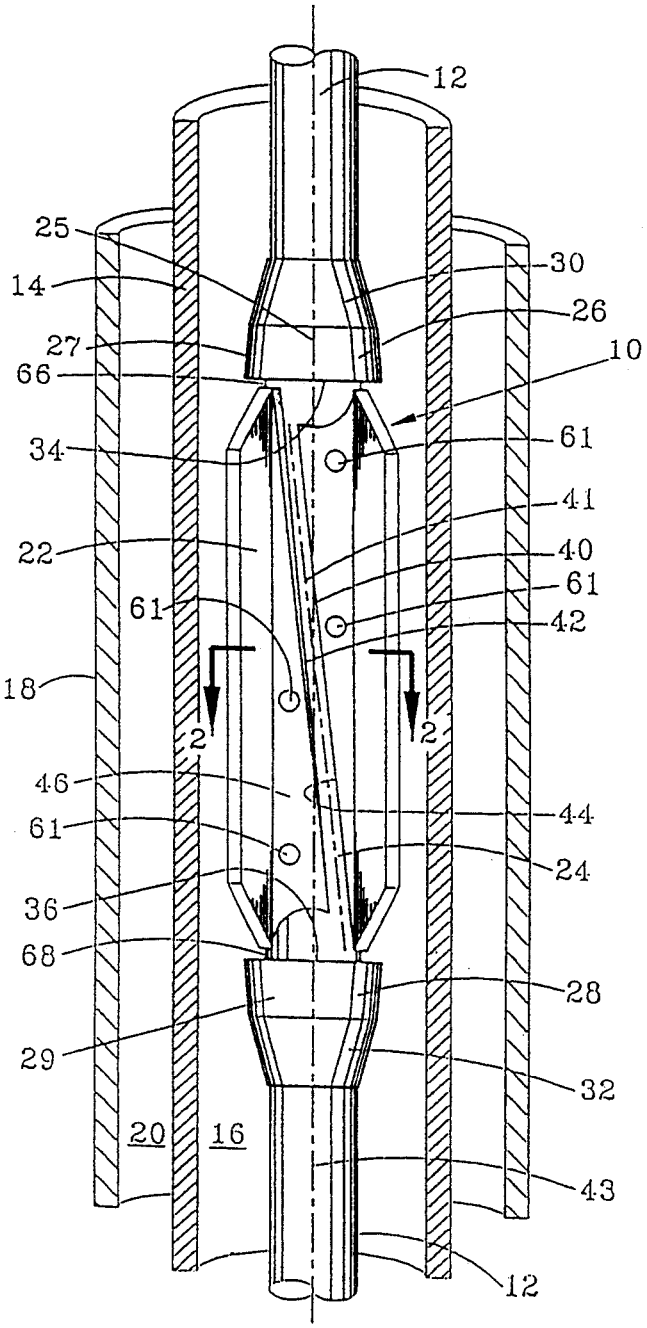
FIG. 1 is a pictorial view, partially in cross section, of a rotating rod guide according to the present invention positioned within a production tubing of a well casing.

FIG. 1 depicts a rotating rod guide according to the present invention. Those skilled in the art will appreciate that the rod guide 10 serves the purpose of maintaining the sucker rod 12 substantially centered within tubing 14, which in turn is substantially aligned and centered within the casing 18 defining a well bore 20 extending from the surface to a subterranean formation. An annulus is thus formed between the I.D. of the casing 18 and the O.D. of a production tubing 14. The flow path 16 within the production tubing is conventionally used for passing contaminated oil to the surface. For the embodiment depicted in FIG. 1, the rod 12 is rotated to drive a pump (not shown) at the lower end of the well bore 20. The rod guide 10 prevents the sucker rod 12 and the couplings (not shown) which interconnect lengths of these sucker rods from engaging the inner surface of the tubing string 14. The downhole pump, in turn, passes contaminated oil up through the flow path 16 in the production tubing 14, and accordingly the pump must also overcome the pressure loss attributable to the restriction in the flow path 16 caused by the rod guide 10.

The rod guide 10 comprises a guide body 22 having a generally C-shaped cross-sectional configuration created by an elongate slot 40 extending along the length thereof. The width of elongate slot 40 is thus defined by the spacing between the opposing sidewalls 42 and 44 on the guide body 22. For reasons explained subsequently, the slot 40 may be inclined at a slight angle of approximately ten degrees, and accordingly the slot centerline 41 is angled as shown in FIG. 1 with respect to the rod guide centerline 43.

The rod guide 10 also includes a spool member 25, which comprises a relatively thin sleeve portion 24 and upper and lower end members 26, 28 at the opposing ends of the sleeve portion 24. Each of the end members 26, 28 has a frustroconical portion 30, 32, respectively, which reduces the pressure loss across the rod guide by providing a streamline body portion between the O.D. of the rod 12 and the O.D. of the stop portion 27, 29, respectively, of the end members 26, 28. Each end member stop portion has a substantially planar stop surface 34, 36, respectively, and each of these stop surfaces lies within a plane substantially perpendicular to the central axis 43 of the rod guide, which axis is generally aligned substantially with the axis of the rod 12. For reasons explained subsequently, a slight gap 66 exists between the upper end of the guide body 22 and the stop surface 34, and a similar gap 68 is shown between the lower end of the guide body and the stop surface 36 on the lower end member 28. The purpose served by these annular gaps 66, 68 is discussed subsequently, although it should be understood that these gaps may be shown in an exaggerated condition in FIG. 1 for clarity.

Figure 2:
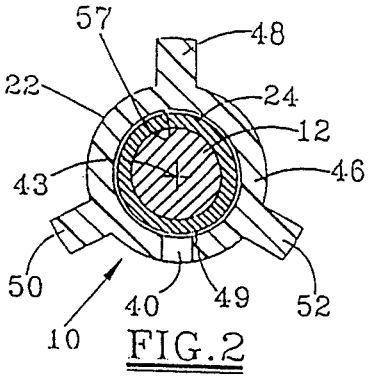
FIG. 2 is a cross-sectional view taken along lines 2—2 in FIG. 1 of the rotating rod guide.

FIG. 2 is a cross-section view through the rod guide 10 shown in FIG. 1, and illustrates the rod guide symmetrically positioned about axis 43. The thin sleeve portion 24 which interconnects the end members 26 and 28 is shown, and this sleeve portion 24 may be molded directly on to the rod 12 to achieve the desired mechanical bond between the spool 25 and the rod 12. The guide body 22 comprises a radially inner body portion 46 having a substantially C-shaped cross-sectional configuration, and three ribs, vanes, or fins 48, 50, and 52 equally spaced circumferentially about and extending radially outward from the C-shaped portion 46. Strong ribs for the guide body are desired, and ribs typically would have a width of greater than 1 centimeter to achieve their desired rigidity. As explained below, the ribs, fins or vanes 48, 50, and 52 minimize flow resistance around the guide, while desirably centralizing the rod 12 within the production tubing 14. It should be understood that the I.D. 57 of the C-shaped portion 46 preferably is defined by a cylinder having a diameter greater than the O.D. 49 of the sleeve portion 24 of the spool member 25, although this annulus is shown in an exaggerated condition in FIG. 2.

The slot 40 preferably has a nominal width (its normal width when the guide body 22 is in a relaxed state) which preferably is less than the O.D. 49 of the sleeve portion 24. The flexibility of the material used for the guide body 22 thus allows the guide body to be snapped on the spool by simultaneously spreading the width of the slot 40 and moving the guide body 22 radially inward toward axis 43, so that the guide body becomes positioned on the sleeve portion 24 and between the end members 26 and 28 of the spool. The angle between the centerline 41 of the slot 40 and the central axis 43 of the guide body improves the lock-on characteristics of the body 22 to remain on the spool 25, and is particularly desirable for a rotating rod guide embodiment, as shown in FIGS. 1 and 2. The preferred slot angle depends on the length of the guide and the circumferential spacing between the fins. If the body 22 is fabricated from less resilient materials, such as metal, it would be desirable for the slot to be straight and wide, thereby minimizing the amount of flexing required to install the guide.

Spool 25 may be formed as a homogeneous unit consisting of the end members 26 and 28 interconnected by the thin sleeve portion 24, and this entire spool member 25 may be molded on a rod 12. Exemplary injection molded materials for the spool member 25 are nylon, glass reinforced nylon, nylon fiber filled (NFF), polyphenylene sulfide (PPS), Hular, Amodel, and Amodel Filled (AF), each of which are relatively hard and abrasive resistant. The sleeve portion of the spool may be mechanically secured to the rod by molding the sleeve portion on the rod. While the upper and lower end members and the sleeve portion may be molded as an integral component to the sucker rod, the upper and lower end members could otherwise be secured to the sleeve portion of the spool. As a further alternative, the sleeve portion of the spool may be eliminated and a relatively thick polymeric coating applied to the sucker rod, either along its entire length or along that portion of the sucker rod engaged by a guide body. In the latter case, end members or stops for positioning the guide body on the sucker rod could be secured directly to the sucker rod, e.g., by welding.

In one preferred embodiment, the material for the body 22 is an ultra-high molecular weight (UHMW) polyethylene material. This material is particularly preferred for the body of the rod guide according to the present inventions, since the selected material is highly resistant to abrasion from sand and other particles contained in the fluid which is passed by the rod guide, and the material has both good wear characteristics and a relatively low coefficient in friction when contacted with the same or other materials. Because of the UHMW characteristics of the guide body 22, the guide body preferably is machined to its desired form rather than being injection molded, but this machining cost is clearly warranted due to the benefits of the UHMW construction and that material's desired characteristics. It should be understood, however, that the guide body could be formed from other materials. Nylon, Amodel, Hular, PPS, NFF, glass reinforced nylon, and bronze are examples of other materials which may be selected for fabricating the guide body 22.

The provision of the slot 40 in the guide body renders the rod guide of the present invention essentially field installable, since the guide body which experiences wear is field replaceable. The spool member 25 may be rigidly secured, e.g., by a molding process or other techniques which permanently or temporarily affix the spool to the rod 22, and the spool 25 thus rotates with the rod relative to the guide body 22. When the guide body 22 thus becomes worn during use (by rotation of the rod in a well), a worn out guide body 22 may be easily snapped off of the spool 25, and a new guide body 22 snapped on in a simple and inexpensive field operation. In addition to providing this desirable field replaceable characteristic for the rod guide body, slot 40 serves another purpose in that the substantial width of the slot allows for easy passage of fluid into and out of the annulus formed between the I.D. 57 of the radially inner body portion 46 of the guide body and the O.D. 49 of the thin sleeve portion 24 of the spool. A substantially C-shaped annular gap is thus formed by this difference between diameters 57 and 49, and relatively clean flowing fluid is available to continuously "wash" the rod guide when in use. The gap between the I.D. of the radially inner body portion 46 and the O.D. of the sleeve portion of the spool preferably is about 2.5 millimeters for a rod guide mounted to a 2.5 cm rotating rod. In part, this washing action allows the body 22 to freely rotate relative to the spool 25, and thus reduces frictional losses.

Figure 3:
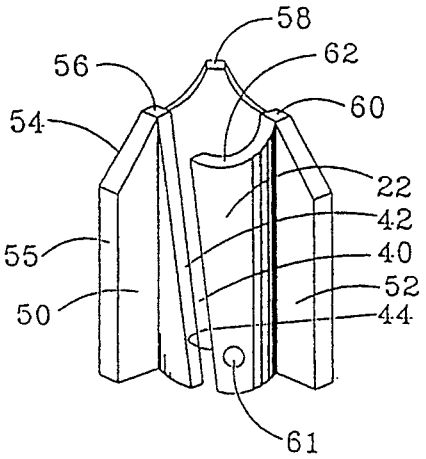
FIG. 3 is a top pictorial view of the upper portion of the rod guide body generally shown in FIGS. 1 and 2.
Figure 4:
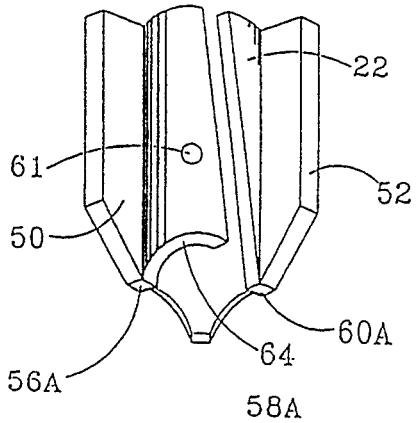
FIG. 4 is a bottom pictorial view of the lower portion of the rod guide body generally shown in FIGS. 1 and 2.

FIGS. 3 and 4 depict upper cut-outs 62 and lower cut-outs 64 formed in the upper and lower ends of the guide body 22. These cut-outs further serve to contribute to the flow of fluid which desirably washes the connection between the guide body 22 and the spool 25. Referring to FIG. 3, each of the cut-outs has a substantially semi-circular or scalloped configuration, and is formed extending circumferentially between the gap which exists between the ribs 48, 50, and 52. FIG. 2 also depicts the inclined portion 54 of each rib which extends from the inner body portion 46 of the guide body 22 to the outer diameter surface 55 of the respective rib, and this inclined portion 54 again contributes to produce a relatively low pressure loss across the stabilizer. The three cut-outs 62 as shown in FIG. 2 each occur over a circumferential length of from about 80° to about 110°, and preferably over a circumferential length of approximately 105°. For this lastly described case, each of the pads 56, 58 and 60, which may be aligned with a respective rib, have a circumferential width of only about 15 degrees. Each of the pads 56, 58, and 60 thus engage the stop surface 34 on the end member 26, and this contact area, which preferably is less than 180°, is sufficient to prevent excessive wear between the pads 56, 58, 60 and the respective end member 26. The substantially longer length of the scalloped cut-outs 62 (together totalling approximately 315° in a preferred embodiment) allow for the desired passage of fluids to wash between the body 22 and the spool 25, as explained above. The depth of each scalloped cut-out 62 may be approximately 1.2 centimeters (cm) at its deepest point for a rod 12 having a diameter of about 2.5 cm, and the cut-outs generally will have a cut-out depth at their deepest point of at least 1 cm. As shown in the drawing, the scalloped cut-out configuration tapers upward to the contact point formed by the pad at the end of each rib. T o still further provide for this desired washing effect, the substantially C-shaped gaps 66 and 68 provide a total axial clearance of from about 1 millimeter (mm) to approximately 3 mm or greater between the ends of the guide body 22 and the stop surfaces on the end members of the spool 25. Also, a plurality of selectively spaced or randomly spaced fluid passageways 61 through the sleeve portion 24 of the spool member 25 (as shown in FIGS. 3 and 4) may be spaced between the ribs, which allow additional circulation and movement of fluid flow around and through the rod guide. The slot 40, in conjunction with the cut-outs 62, 64, the annulus between the surfaces 57 and 49, the gaps 66 and 68, and the optional fluid passageways 61, thus all contribute to maximum the flow of fluids around and through the rotating rod guide, which flow continually washes the abrasives through the guide and substantially reduces the likelihood of particles becoming trapped between the rotating and stationary components, thereby causing high abrasive wear on the spool 25 or the guide body 22.

FIG. 4 depicts a bottom view of a portion of the rod guide 22 described above, and illustrates three similar scalloped cut-outs 64 provided between each of the ribs 48, 50 and 52, thereby producing corresponding lower pads 56A, 58A, and 60A which normally engage the planar end surface 36 on the lower end member 28 of the spool 25. It is apparent that for a rod guide designed for use on a rotating rod string, the guide body which contacts the interior surface of the production tubing preferably is not mechanically fixed to the rod, but rather allows the rod to rotate within the guide body, which may move at a lower RPM or be stationary with the tubing string. By allowing the fins or ribs of the guide body to remain stationary, a lower resistance to turning the rod is obtained, particularly as the side loading increases the radial force acting between the spool and the rod guide body. This construction also reduces unwanted hydraulic resistance and turbulence created in the fluid stream when the guides are rotating, thereby further reducing the resistance to turning the rod. Tubing wear is substantially reduced or eliminated because the guide body no longer rotates against the production tubing 14. Since the fins remain stationary with respect to the rotating spool and rod, the fins do not experience high wear, and the importance of a high EWV is significantly reduced. For a rotating rod guide as described herein, the thickness of the fins can thus be minimized, although the fins must be sized to withstand the anticipated side loading. By minimizing the width of the fins and thus the EMV, the pressure drop across the rotating rod guide is desirably minimized. The rod guide as shown in FIGS. 1–4 is particularly advantageous for use on a rotating rod string within a production tubing which passes fluids to the surface with high solid abrasive contents.

In its relaxed start, the O.D. of the rod guide body 22 is slightly greater than the I.D. of the production tubing 14. When the guide body 22 is forced closed into the tubing 14, its O.D. may be sized with respect to the tubular so that it closes slightly (reducing the width of the slot), but not enough to prevent the spool 25 from freely rotating with the rod while the body 22 remains stationary. This slight closing action by the guide body is advantageous since it ensures the fins stay in contact with the production tubing, thus reducing the tendency of the body 22 to rotate with the rod. This feature is particularly desirable for rotating rod guide embodiments wherein the guide body is fabricated from a comparatively resilient material, such as a UHMW polyethylene.

The power required to operate a progressing cavity pump system has to overcome three primary sources of resistance to rotation of the rod string: mechanical friction, hydraulic friction, and the pressure drop. If the power to accomplish this task can be reduced at the same production flow rate, then the production efficiency increases. The first of these resistances, mechanical or Coulomb friction, occurs when two surfaces are rubbed together. The force of the resistance is theoretically independent of the areas of interference and a function only of the normal force and the coefficient of friction. Because frictional resistance is closer to the center of the sucker rod, however, the design as shown in FIGS. 1–4 has less resisting torque than experienced by a rod guide fixed to a sucker rod, which rod guide then rotatably engages a tubing string. Less torque thus translates to less power required to operate the pump. Calculations indicate that required torque will decrease by a factor of approximately 2.5 if a 2.5 cm rod spins through a 6.5 cm guide, rather than having a 6.5 cm guide secured on a 2.5 cm rod turn against the tubing string.

The second friction, hydraulic friction, occurs as the guide rotates in the fluid, in a manner similar to rotation of a paddle wheel on a river boat. The resulting energy loss is less if the guide remains stationary and the rod rotates inside the guide. Measurements have indicated that the hydraulic resistance for the design as discussed above compares favorably with the hydraulic friction resistance for other rod guides. Specifically, the power required to turn a 2.5 cm rod at 100 RPM in a 6.3 cm tubing string (passing fresh water as the flowing medium), with no induced side load, is somewhat greater than the power required for rotating a bare rod, but is generally less than the power required to rotate a rod guide body which is affixed to the rod. The power required to rotate this same rod at 200 RPM, with fresh water as the flowing media and again with no induced side load, is substantially less than the power required to rotate a rod guide affixed to a bare rod. Similar results were achieved when the rod was rotated at 300 RPM, 400 RPM, 500 RPM, 600 RPM, 700 RPM, 800 RPM, and 900 RPM with no induced side loads. The flow through the tubing during this test varied form about 200 barrels per day (BPD) to about 2400 BPD.

The third primarily source of resistance which must be overcome by a progressive cavity pump is the pressure drop. The pump must receive enough power through the rod string to overcome the hydrostatic pressure of the fluid column, plus the pressure drop resulting from fluid flowing through the tubing and around the rod string. This power thus decreases if the pressure drop generated by the fluid flowing in the flow path 16 past the rod guide decreases, and accordingly rod guides which generate the least amount of pressure drop reduce the power and improve the production efficiency for the system.

Figure 8:
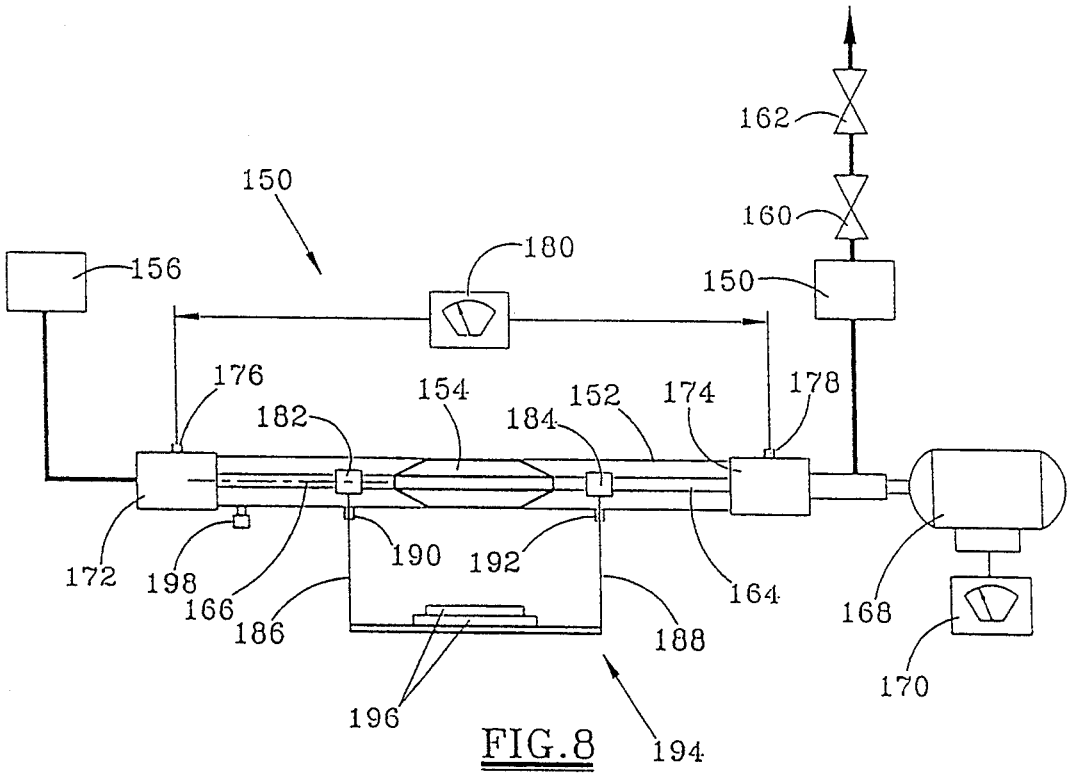
FIG. 8 is a simplified schematic representation of a test apparatus according to the present invention for testing the characteristics of a rod guide.

Referring to FIG. 8, a test system 150 was devised for measuring these three primary sources of resistance. The tests unit comprises a tubing 152, which preferably may be fabricated from an acrylic material so that the operator can visually view the rod guide 154 as a selected fluid is passed through the acrylic tubing 152. A fluid supply source 156, such as a water pipe, thus passes fluid through the tubing 152 and past the rod guide 154. A flowmeter 158 allows for the accurate measurement of the volume of fluid flow through the tubing 152, and one or more metering valves 160, 162 allow the flow rate to be conveniently adjusted. The acrylic tubing 152 is substantially horizontally mounted, so that the rod 164 has a substantially horizontal axis 166 aligned with the axis of the acrylic tubing 152, thereby neutralizing the effect of hydrostatic head on the pressure drop reading. A variable speed motor 168 is provided for rotating the rod 164, and an amp meter 170 allows the test operator to easily detect and record the power consumed by the motor 168 during this rotating process. Sealed coupling boxes 172 and 174 are provided for supporting the rotating rod 164, and provide tap outlets 176, 178 so that a pressure tester 180 may be used to continually detect and record the pressure drop across the guide 154, or more accurately the pressure drop between the sealed coupling boxes 172 and 174. A pair of bearing assemblies 182, 184 are also provided on the rod 164 at opposing ends of the rod guide 154, and are mounted so that steel wires 186, 188 may extend downwardly from the bearing assemblies 182, 184, as shown in FIG. 8, with these wires passing through wire sealing members 190, 192, respectively. A force transmitting device 194, which may take form of weight members 196, thus allows a uniform force to be transmitted through the wires 186 and 188 and to the bearing assemblies 182 and 184, thereby simulating a known side loading placed on the rod guide 154 if the rod guide were rotating in a vertical well.

By having the axis 166 horizontal, the hydrostatic portion of the pressure drop readings was negated. Tap water may be used as a flowing medium for conducting a test, although other selected fluids may also be employed. Use of acrylic tubing allows for the photography of turbulence associated with various rotating elements, and small amounts of compressed air may be introduced into the flowing medium from source 198 in order to make the streamlines visible. The power required to rotate a bare rod significantly increased between 100 and 400 RPM, and this increase was presumably attributable to the "whipping" action that resulted from its relatively long unsupported length. If the rod is mounted vertical so that it is in tension, this dramatic increase probably would not have occurred. It thus may be expected that a bare rod would have the least hydraulic resistance compared to use of a rod guide as shown in FIGS. 1–4. For the tests as described above, however, rotation of a bare rod above 400 RPM was not recorded because of the excessive whipping action. The tests showed that the hydraulic resistance increased with an increase in either rotational speed and/or flow rate. The rotating guide as shown in FIGS. 1–4 may have a substantially low resistance compared to prior art products, however, and this advantage progressively increases as the flow rate and rotational speeds increase. Those skilled in the art will appreciate that modifications to the bearing assemblies 182, 184, the wire sealing members 190, 192, and the drive motor 168 may be made to test the characteristics of a reciprocating rod guide according to this invention.

Figure 5:
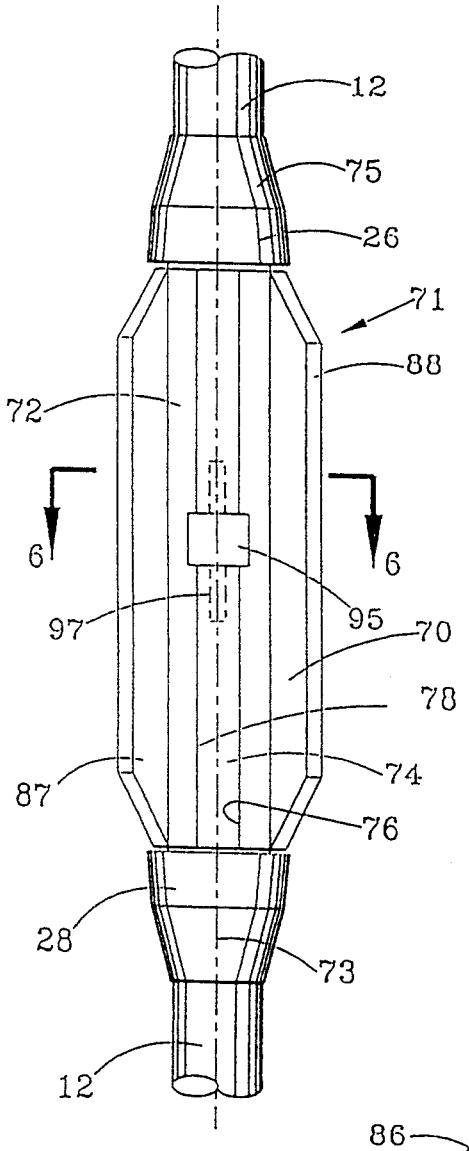
FIG. 5 is a pictorial view of one embodiment of a reciprocating rod guide according to the present invention.
Figure 6:
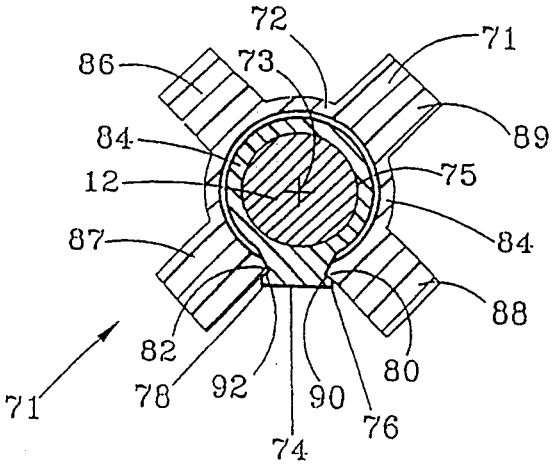
FIG. 6 is a cross-section view taken along lines 6—6 in FIG. 5 of the reciprocating rod guide, although the optional components 95 and 97 in FIG. 5 are not shown in FIG. 6.

FIG. 5 depicts a rod guide 71 according to the present invention for use with a reciprocating rod 12. The rod guide 71 comprises a guide body 70 having a radially inward portion 72 with a substantial C-shaped cross-sectional configuration, as shown in FIG. 6, and a plurality of ribs 86, 87, 88, and 89 also shown in FIG. 6. As is apparent from FIGS. 1 and 3, the slot provided in the guide body for field installation of the body on the spool member is not inclined, but rather is substantially parallel with the axis 73 of the reciprocating rod guide 71.

The spool 75 for the rod guide depicted in FIGS. 5 and 6 may be substantially identical to the spool 25 previously discussed, and includes thin wall sleeve portion 84 interconnecting end members 26 and 28 as previously described. The spool 75 may be directly molded on the rod 12, or may be bonded by glue or otherwise affixed to the rod 12. As shown in FIG. 6, the spool includes an elongate projection 74 protruding radially outwardly from the sleeve portion 84 and extending axially along the length of the portion 84 from the end member 26 to the end member 28. This projecting portion 74 has a dovetail configuration which includes a protruding lip portions 76 and 78 as shown in FIG. 6, which in turn define elongate gaps 80 and 82, respectively, which are spaced radially inward from the lip portions 76 and 78. These gaps 80 and 82 thus receive elongate projections 90 and 92 provided at the ends of ribs 87 and 88, and together these components serve to rotatably lock the guide body 70 on the modified spool member 75. Since rotation between the guide body and the spool is prohibited for the reciprocating version of the rod guide, washing of the guide body to spool connection is not required. Accordingly, the end surfaces of the guide body need not but may define the annular gaps 66 and 68 previously discussed between the ends of the guide body and the stop surfaces. Also, the guide body 70 need not include the through passageways 61 as shown in FIGS. 3 and 4, since washing between the guide body and the spool is not required. It should be understood that the projection 74 from the sleeve portion 72 of the spool as shown in FIG. 6 need not be continuous, and one or more projections may be spaced along the length of the sleeve portion 72 between the spool end members 26 and 28.

Figure 7:
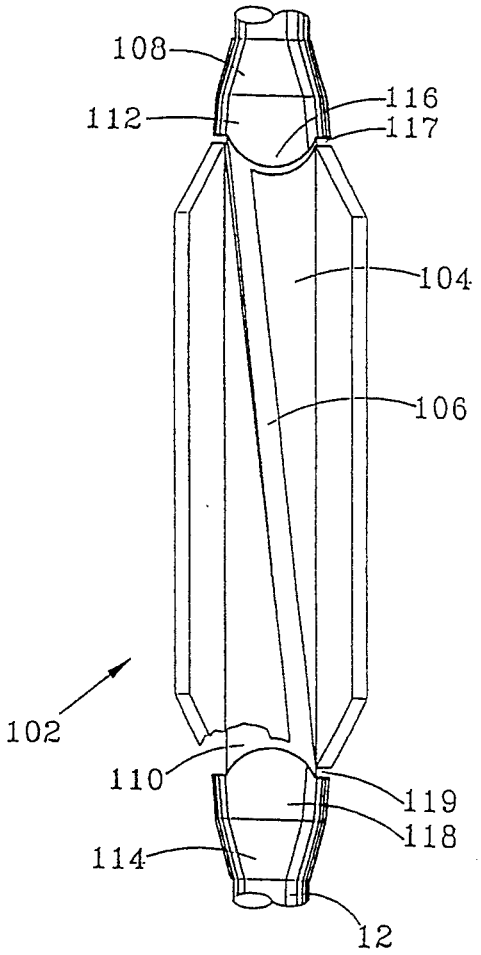
FIG. 7 is a pictorial view of another embodiment of a reciprocating rod guide according to the present invention, with the reciprocating rod guide including a guide body as shown in FIGS. 1–4.

FIG. 7 depicts an alternate version of a rod guide 102 for use on a reciprocating rod 12. The guide body 104 may be substantially the same as the guide body 22 discussed above for the rotating rod guide, although the slot 106 need not be as wide as the slot 40 for the rotating guide body since the slot need not perform the function of assisting in washing between the spool and the guide body. Also, the annular gaps 66 and 68, and the passageway 61 need not be provided in the guide body. By providing a desired width for the slot 106 and a desired material thickness for the radially inward body portion of the guide body, the lock-on characteristics of the reciprocating guide body 104 or the rotating guide body 22 may be improved. In most applications, the width of the slot in the guide body will be less than 110% and more than 10 % of the outer diameter of the sleeve portion of the spool. The desired slot width should allow for easy installation of the guide body on the spool, while simultaneously obtaining a rod guide which can be reliably attached to the spool without damaging the rod guide body. The flexibility of the body to expand the slot and snap about the spool is determined by the selected material for constructing the guide body and the selected thickness of the guide body exclusive of the fins (the radially inner body portion 46 of the body as shown in FIG. 2).

The spool 108 depicted in the FIG. 7 embodiment is similar to the spools previously discussed, and includes a thin walled sleeve portion 110 between end members 112 and 114. The frustroconical configuration of the end members also minimizes pressure drop and resulting drag force across the reciprocating rod guide, and facilitates installation and removal of the rod string and rod guides supported thereon into the production tubing. The stop surfaces 117 and 119 on the end members 112 and 114 are not substantially planar, however. The end members 112 and 114 rather include a plurality of scallop-shaped projections 116 on the upper end member 112 and similar scalloped shaped projections 118 on the lower end member 114. These projections cooperation with a corresponding number of scalloped-shaped cutouts in the guide body 104 to prohibit rotation of the body 104 relative to the modified spool 108. When the guide body 104 as shown in FIG. 7 is thus snapped onto the spool 108, the concave and convex surfaces of the scalloped projections and cut-outs interlock in order to hold the guide body in place and prevent rotation of the guide body 104 relative to the spool 108. A significant advantage of the FIG. 7 embodiment is that the same guide body may be used regardless of whether the guide was used on a rotating or a reciprocating rod string.

Supply stores could thus stock sucker rods with spools and provide oil recovery operators with guide bodies as necessary on an as-needed basis. The inventory for rods with spools may be reduced in view of the numerous materials which may be used for fabricating the guide bodies, so that rods with standard guide bodies molded thereon and spools of a selected material are ordered by the oil recovery operator.

Another attachment mechanism for securing a guide body on a spool may include a gripping device which is positioned along a slot that runs throughout all or a portion of the length of the guide body. After installation on a spool, this gripping device would thus be securable to the sides of the guide body which defined the width of the slot in the guide body. The gripping device 95 conceptually shown in FIG. 5 could engage a channel or groove 97 also conceptually shown in FIG. 5, with this groove 95 being provided within the sleeve portion of the spool. This gripping device and groove thus cooperate to prevent rotation of the guide body relative to the spool. Various other mechanisms could be used to secure the guide body to a spool affixed to a reciprocating rod.

Those skilled in the art will appreciate that any number of fins or vanes may be provided on a guide body, although preferably at least three and less than seven such fins are provided. For many applications, three circumferentially spaced fins are preferred. The concepts of the present invention may be applied to a guide body without fins, in which case the outer diameter of the guide body would be the surface which engaged the production tubing.

The design of the rod guide for a rotating rod and a reciprocating rod according to the present invention, along with the selection of materials as discussed above, provide high protection for the rod and maximize the benefit to the fluid pumping operator. The field serviceability feature of the rod guide is a significant advantage of this invention compared to prior art designs. Once a rod guide (whether for cooperating with a rotating rod or a reciprocating rod) has been worn down to the point that the rod or rod coupling contacts the tubing, the rod guide can be snapped off the spool and a new guide snapped on the spool in its place. The rod need not be returned to the shop for installation of the guide bodies, and the replacement operation is easily accomplished in the field. A large screwdriver may be used to assist in spreading apart the slot to install the guide body on the spool secured to the rod. A pry bar or various embodiments of expansion pliers of the type used to spread apart other devices may also be used to assist in installation and removal of a guide body on a spool.

The design of the rod guide according to the present invention also allows for a number of different materials to be utilized to form the spool, and various mechanism may be used to bond or secure the spool to the rod. Various alternative techniques may thus be used to form a suitable spool and mechanically fix the spool to the rod, either permanently or temporarily. Various attachment devices, such as locking sleeves or locking bolts, may be utilized to temporarily affix a spool to a rod, yet allow the spool to be disconnected from the rod and moved to another axial location along the rod. The connection formed between the sleeve portion of the spool and the rod is preferably made, however, during the spool molding process described above. The sleeve portion and the end members of the spool also need not be formed as an integral unit, but rather may be connected by various mechanisms. Those skilled in the art will further appreciate that the sleeve portion of the spool may extend substantially, although perhaps not completely, between the end members, while still providing the desired purpose of positioning the guide body about the rod, and affixing the end members of the spool to the rod.

As previously noted, the material for the guide body is a significant feature of the present invention, although various moldable or machinable materials other than UHMW polyethylene may be provided. The selected material for the body preferably results in a substantially rigid construction, yet nevertheless has sufficient flexibility to enable easy installation of the guide body on a spool at the well site. The currently preferred material for the guide body is a UHMW polyethylene material, although the guide body could be fabricated from various other plastic materials, rubber, or metal. A UHMW polyethylene material generally has a polymer chains at least 10 to 20 times longer than the polymer chains for high density polyethylene. A UHMW polyethylene material, as defined herein, is a polymer which has weight average molecular weight greater than 30,000,000. The material for the guide body may also be an alloy comprising a UHMW polyethylene and one or more other selected polymers, with the UHMW polyethylene in such an alloy preferably being at least 10% by weight of the weight of the alloy. A pure UHMW polyethylene material is thus not required, and the selected alloy will be a function of material costs, the desired low coefficient of friction, wear and abrasive characteristics, and other factors. A plastic material currently preferred for the guide body is one having at least 50% by weight UHMW polyethylene. The UHMW polyethylene material may be compression molded or ram extruded, since injection molding and screw extrusion of this material have resulted in limited success due to polymer degradation and/or equipment damage. Raw material for forming the UHMW bar stock material is a fine powder, and the resin preferably neither melts nor exhibits a measurable melt flow index during its forming process. The compression molded UHMW polyethylene material may be forged, joined with hot plate welding or spin welding, stamped, or machined using normal drilling, milling, turning, sawing, planing, or screw cutting operations.

Materials other than UHMW polyethylene or an alloy containing UHMW polyethylene may be also used for fabricating the guide body. Any polymer resin or alloy of polymers that provide suitable performance in tensile strength, elongation, impact properties and lubricity may be used. Polymers having molecular weight above 500,000 are likely candidates. Bronze and brass are likely candidates for fabricating a metal guide body, and these metal materials would make the guide body more wear resistant than if fabricated from standard plastic materials. For the reciprocating rod guide embodiments wherein the guide body is secured to the spool, bronze would be a particularly preferred material for fabricating a rod guide. If the guide body is fabricated from metal, the nominal width of the slot may be greater than 110% of the outer diameter of the sleeve portion of the spool for the rotating guide body with an angled slot. For this rotating rod guide embodiment, the stop surfaces on the spool end members also may be spaced apart axially a distance substantially greater than the axial length of the guide body.

According to the method of the present invention, excess spools may be initially molded on a rod, e.g., spools in excess of the number of rod guides desired along that length of rod may be provided slightly above or below the spool intend for initial use with a guide body. A rubber sleeve (not shown) may be placed over an unused spool to simply protect the spool from wear, with this rubber sleeve having an outer diameter only slightly greater than the spool and thus not serving to centralize the rod within the production tubing. If one or more of the spools should become excessively worn, the worn guide body may then be removed from the worn spool, the protective rubber sleeve removed from the previously unused spool spaced slightly above or below the worn spool, and a new guide body then snapped onto the new spool. This feature of the invention even further reduces the overall cost of maintaining the rod string centered within the tubing string, since the return of sucker rods to the manufacturing facility for molding on new spools is substantially reduced or eliminated.

According to the method of the present invention, a rod guide is positioned on a sucker rod by securing a spool having opposing end members and a sleeve portion to the sucker rod. The guide body is formed having a passageway therein for receiving the sleeve portion of the spool, with the guide body having a slot along the length of the guide body, and the slot having a selected width as a function of the construction material for the guide body and the diameter of the sleeve portion of the spool. The guide body may then be moved radially inward with respect to the sleeve portion of the spool while spreading apart the slot in the guide. Once the guide body is positioned on the spool, the spreading force may be released, thereby allowing the guide body slot to substantially return to its original width. The spool may be formed by molding the spool directly on a rod, as previously explained. For the rotating rod guide, the passageway in the guide body has an interior diameter greater than the diameter of the sleeve portion of the spool, and the slot has a width sufficient to facilitate flow in and out of an annulus between the guide body and the spool. Cut-outs may be formed in the guide body to provide communication to and from the annulus between the guide body and the sleeve portion of the spool, with the cut-outs providing a plurality of pads for engagement with stop surfaces on corresponding spool end members. Various attachment members may be used for securing the guide body to a spool for a reciprocating rod guide, and the spool may be modified, as shown in FIG. 7, so that the same guide body may be used on either a rotating or a reciprocating rod.

The concepts of the present invention, while particularly well suited for protecting a rotating or reciprocating rod used to drive a downhole pump, may also be applied for protecting other tubular goods which are rotating or reciprocating within a well bore. The concepts of the present invention may thus be used to devise a guide for protecting a drill pipe rather than a sucker rod, since engagement of a rotating drill pipe with a casing string or open hole also results in excessive wear on either the drill pipe string or the casing string.

The foregoing disclosure and description of the invention are thus illustrative, and changes in both the apparatus of the rod guide and in the method of constructing and operating a rod guide as described above may be made with departing from the present invention.

What is claimed is:

1. A rod guide for centering within a tubular string a sucker rod which transmits power to a pump within a well bore, the rod guide comprising:

a spool securable to the sucker rod, the spool having upper and lower end members with respective upper and lower stop surfaces thereon, and a sleeve portion for securing about the sucker rod and having a sleeve outer diameter, the sleeve portion extending at least substantially between the upper and lower spool end members;

a guide body having an elongate slot therein extending along the length of the guide body, the guide body having a generally cylindrical inner surface, the guide body slot having a nominal selected width for positioning the guide body on and removing the guide body from the sleeve portion of the spool; and the guide body being selected from a plastic material having at least 10% by weight UHMW polyethylene, and including a radially inward portion having C-shaped cross-sectional configuration and a plurality of fins extending radially outward from the radially inward portion for engagement with the tubular string.

2. The rod guide as defined in claim 1, wherein:

the sleeve portion of the spool is mechanically secured to the sucker rod by molding the sleeve portion of the spool on the sucker rod; and the selected plastic material is at least 50% by weight UHMW polyethylene.

3. The rod guide as defined in claim 2, wherein the upper and lower end members and the sleeve portion of the spool are molded as an integral component to the sucker rod.

4. The rod guide as defined in claim 1, wherein the generally cylindrical inner surface of the guide body has a diameter greater than the sleeve outer diameter of the spool; and the guide body includes a plurality of cut-outs adjacent at least one end of the guide body for transmitting fluids from outside the guide body to an annular gap between the guide body inner surface and the sleeve outer diameter of the spool.

5. The rod guide as defined in claim 4, wherein the plurality of cut- outs have a generally scalloped shaped configuration and define a plurality of end pads for engagement with a stop surface on a respective spool end member, the circumferential length of the plurality of end pads formed by the plurality of scalloped cut-outs at one end of the guide body having a combined arcuate angle of pad surface for engagement with the respective stop surface of less than 180 degrees.

6. The rod guide as defined in claim 1, wherein the elongate slot in the guide body is angled with respect to a central axis of the spool.

7. The rod guide as defined in claim 1, wherein the slot in the guide body has a nominal minimal width of less than 110% and more than 10% of the sleeve outer diameter of the spool, such that the substantial width of the slot facilitates fluid flow between the guide body and the spool.

8. The rod guide as defined in claim 1, wherein the axial spacing between the stop surfaces on the upper and lower end members of the spool provides a gap of at least one millimeter between the stop surfaces and the engaging ends of the guide body.

9. The rod guide as defined in claim 1, further comprising:

an attachment mechanism for securing the guide body to the spool and preventing rotation of the guide body relative to the spool.

10. The rod guide as defined in claim 9, wherein the attachment mechanism comprises:

at least one of the upper and lower spool end members including projections for mating engagement with the spool to prevent rotation of the guide body relative to the spool.

11. A rod guide for guiding a rotating rod with respect to a tubular member within a well bore, the rod guide comprising:

a spool securable to the rod, the spool having upper and lower end members with respective upper and lower stop surfaces thereon, and a sleeve portion for securing about the rod and having a sleeve outer diameter, the sleeve portion extending at least substantially between the upper and lower spool end members;

a guide body having a radially inward portion with a C-shaped cross-sectional configuration formed by an elongate slot within the guide body, the slot extending along the length of the guide body, the guide body having a generally cylindrical inner surface having a guide body inner diameter greater than the outer diameter of the sleeve portion of the spool;

the guide body slot having a nominal selected width for positioning the guide body on and removing the guide from the sleeve portion of the spool; and the guide body having one or more cut-outs therein adjacent at least one end of the guide body, the one or more cut-outs forming one or more end pads at the at least one end of the guide body for engagement with a respective one of the upper and lower stop surfaces.

12. The rod guide as defined in claim 11, wherein the one or more end pads at one end of the guide body having a combined circumferential arcuate length for engagement with the respective stop surface of less than 180 degrees.

13. The rod guide as defined in claim 11, wherein the guide body further includes a plurality of radially outward projection fins for engagement with the tubular member to hold the guide body stationary while the spool rotates with the rod.

14. The rod guide as defined in claim 11, wherein the slot in the guide body is angled with respect to a central axis of the rod guide to facilitate retaining the guide body on the spool.

15. The rod guide as defined in claim 11, wherein the slot in the guide body has a nominal width of less than 110% and more than 10% of the sleeve outer diameter of the spool, such that the substantial width of the slot facilitates fluid flow between the guide body and the spool.

16. The rod guide as defined in claim 11, wherein the spacing between the stop surfaces is at least 1 millimeter greater than the spacing between end surfaces of the guide body which engage the stop surfaces, such that the gap formed by this spacing facilitates fluid flow between the guide body and the spool.

17. The rod guide as defined in claim 11, wherein the guide body is formed from a UHMW plastic material having at least 50% by weight UHMW polyethylene.

18. The rod guide as defined in claim 11, wherein the guide body includes a plurality of radially outwardly projecting fins for engagement with the tubular string.

19. The rod guide as defined in claim 11, wherein the cut-outs have a generally scalloped-shaped configuration and each cut-out has an axial depth at its deepest point of at least 1 centimeter.

20. The rod guide as defined in claim 11, wherein the radially inward portion of the guide body includes a plurality of fluid passageways therethrough to facilitate fluid flow between the guide body and the sleeve portion of the spool.

21. A rod guide for positioning about a rod powered for reciprocation within a tubular string of a well bore to drive a downhole pump, the rod guide comprising:

a spool securable to the rod, the spool having upper and lower end members with respective upper and lower stop surfaces thereon, and a sleeve portion for securing about the rod and extending at least substantially between the upper and lower spool end members;

a guide body having a radially inward portion with a generally C-shaped cross-sectional configuration formed by an elongate slot therein extending along the length of the guide body, the guide body having a generally cylindrical inner surface for positioning about the sleeve portion of the spool, the slot having a nominal width for positioning the guide body on or removing the guide body from the sleeve portion of the spool; and an attachment mechanism for cooperating between the spool and the guide body to prevent rotation of the guide body relative to the spool.

22. The rod guide as defined in claim 21, wherein the guide body is formed from a plastic material having at least 50% by weight UHMW polyethylene.

23. The rod guide as defined in claim 22, wherein the end members and the sleeve portion of the spool are formed as an integral unit molded on the rod.

24. The rod guide as defined in claim 21, wherein the slot has a nominal width of more than 10% of the sleeve outer diameter of the spool.

25. The rod guide as defined in claim 21, wherein the attachment mechanism comprises:

a projecting stop member affixed to and protruding radially outward from the sleeve portion of the spool for positioning within the elongate slot in the guide body.

26. The rod guide as defined in claim 25, wherein the projecting stop has a generally dovetail configuration and includes a protruding lip portion radially outward from a recess in the projecting stop for receiving a portion of the guide body.

27. The rod guide as defined in claim 21, wherein the attachment means comprises:

the guide body having one or more cut-outs along at least one of an upper end and a lower end of the guide body; and the spool having protrusion for fitting within the cut-outs provided in the guide body and thereby preventing rotation of the guide body about the spool.

28. The rod guide as defined in claim 27, wherein the guide body comprises:

the one or more cut-out includes a plurality of substantially scalloped-shaped cut-outs at both the upper and lower ends of the guide body; and each corresponding end member of the spool having a plurality of corresponding scalloped-shaped protrusions for fitting within the scalloped-shaped recesses in the guide body and thereby preventing rotation of the guide body with respect to the spool.

29. The rod guide as defined in claim 21, wherein the attachment means comprises:

a groove along the sleeve portion of the spool; and a gripping device spaced at least partially within the slot of the guide body, the positioning device being securable to the guide body and engaging the groove in the spool to prevent rotation of the guide body with respect to the spool.

30. A guide body for positioning on a spool having a sleeve portion securable to a rod guide, the guide body comprising:

the guide body having a central passageway for receiving the sleeve portion of the spool and an elongate slot extending along the length of the guide body, the guide body slot having a nominal selected width for positioning the guide body on and removing the guide body from the sleeve portion of the spool; and the guide body being selected from a plastic material having at least 10% by weight UHMW polyethylene, and including a radially inward portion having C-shaped cross-sectional configuration and a plurality of fins extending radially outward from the radially inward portion.

31. The guide body as defined in claim 30, wherein the passageway in the guide body has a generally cylindrical inner surface with a diameter greater than an outer diameter of the sleeve portion of the spool.

32. The guide body as defined in claim 31, wherein the guide body includes a plurality of cut-outs adjacent at least one end of the guide body for transmitting fluids from outside the guide body to an annular gap between the guide body inner surface and the outer diameter of the sleeve portion of the spool.

33. The guide body as defined in claim 30, wherein the slot in the guide body has a nominal width of less than 110% and more than 10% of the outer diameter of the sleeve portion of the spool.

34. The guide body as defined in claim 30, wherein the guide body has one or more cut-outs therein adjacent at least one end of the guide body, the one or more cut-outs forming one or more end pads at the at least one end of the guide body for engagement with a stop surface on the spool.

35. The guide body as defined in claim 33, wherein the one or more end pads at one end of the guide body have a combined circumferential arcuate length for engagement with a stop surface on the spool of less than 180 degrees.

36. The guide body as defined in claim 30, wherein an axial spacing between the stop surfaces on the upper and lower end members of the spool provides a gap of at least one millimeter between stop surfaces on the spool and corresponding stop surfaces on the guide body.

37. The guide body as defined in claim 30, further comprising:

an attachment mechanism for cooperating between the spool and the guide body to prevent rotation of the guide body relative to the spool.

38. The guide body as defined in claim 37, wherein the attachment means comprises:

the guide body having one or more cut-outs along at least one of an upper end and a lower end of the guide body for securing the guide body to the spool and thereby preventing rotation of the guide body about the spool.

39. The guide body as defined in claim 37, wherein the attachment comprises:

a gripping device spaced at least partially within the elongate slot of the guide body, the positioning device being secured to the guide body and engaging the spool to prevent rotation of the guide body with respect to the spool.

40. The guide body as defined in claim 30, wherein the plastic material of the guide body has at least 50% by weight UHMW polyethylene.

* * * * *

UNITED STATES PATENT AND TRADEMARK OFFICE

CERTIFICATE OF CORRECTION

PATENT NO. : 5,339,896

DATED : August 23, 1994

INVENTOR(S) : Charles Hart, et al.

It is certified that error appears in the above-identified patent and that said Letters Patent is hereby corrected as shown below:

In column 2, line 60, delete "5,119,876" and insert therefor --5,191,938--.

Signed and Sealed this

Twenty-eight Day of March, 1995

*Attest:*

Bruce Lehman

BRUCE LEHMAN

*Attesting Officer*

*Commissioner of Patents and Trademarks*